US005450804A

United States Patent [19]

Nagasaka et al.

[11] Patent Number: 5,450,804

[45] Date of Patent: Sep. 19, 1995

[54] LOCK STITCH MACHINE

[75] Inventors: Nobusuke Nagasaka, Aichi; Kenji Matsubara, Nagoya; Hidetaka Inagaki, Nagoya; Akihiro Wakayama, Nagoya, all of Japan

[73] Assignee: Brother Kogyo Kabushiki Kaisha, Nagoya, Japan

[21] Appl. No.: 171,422

[22] Filed: Dec. 22, 1993

[30] Foreign Application Priority Data

Feb. 8, 1993 [JP] Japan ..... 5-019914

[51] Int. Cl.[6] ..... D05B 57/08

[52] U.S. Cl. ..... 112/181

[58] Field of Search ..... 112/197, 162, 199, 201, 112/260, 269.1, 181, 184, 182, 183

[56] References Cited

U.S. PATENT DOCUMENTS 4,356,782 11/1982 Ueyama et al. ..... 112/197
5,154,129 10/1992 Schips ..... 112/197

FOREIGN PATENT DOCUMENTS 54-27785 9/1979 Japan .
63-32702 8/1988 Japan .
2-154788 6/1990 Japan .

*Primary Examiner*—Peter Nerbun
*Attorney, Agent, or Firm*—Oliff & Berridge

[57] ABSTRACT

A lock stitch machine capable of being selectively set for either an overcasting mode or a hemming mode. A needle plate tongue is shifted between an operative position and an inoperative position in a region separated from the operating region of the looper, along a path substantially resembling a circular arc for a vertical displacement and a horizontal displacement greater than the vertical displacement, by turning an overcasting width adjusting knob which turns a control shaft. Thus, the needle plate tongue can be shifted between the operative position and the inoperative position regardless of the position of the looper thereby facilitating the stitching mode changing operation.

9 Claims, 5 Drawing Sheets

LOCK STITCH MACHINE

BACKGROUND OF THE INVENTION

1. Field of the Invention

The invention relates to a lock stitch machine capable of changing its stitching mode from an ordinary overcasting mode in which the flat edge of a workpiece is overcast by overcast stitches, by shifting the needle plate tongue which cooperates with the needle and the looper downward below the throat plate, to a hemming mode in which the edge of a workpiece is rolled and stitched.

2. Description of the Related Art

In a lock stitch machine of this type, the stitch tongue is disposed fixedly on the right-hand side of the throat plate so that the upper end of the stitch tongue and the upper surface of the throat plate are included in a plane. The stitch tongue cooperates with the needle and the looper for hemming.

The needle plate tongue for overcasting the flat edge of a workpiece is capable of moving between a working position where the needle plate tongue engages in the overcasting operation and an inoperative position where the needle plate tongue is disengaged from the overcasting operation. When positioned at the operative position, the needle plate tongue is set beside the stitch tongue and the throat plate and operates in cooperation with the needle, the looper and the stitch tongue to form overcast stitches. When forming ordinary overcast stitches, the needle and the looper extend the thread between the needle plate tongue and the stitch tongue to form overcast stitches in the flat edge of a workpiece.

When hemming the edge of a workpiece, the needle plate tongue is shifted from the operative position to the inoperative position. The inoperative position is near the operative position, and the needle plate tongue held at the inoperative position does not interfere with the looper and does not obstruct the stitching work of the operator.

A lock stitch machine capable of operating in either of such different stitching modes is disclosed in Japanese Patent Publication No. Sho 54-27785. In this known lock stitch machine, the inoperative position of the needle plate tongue is below the looper, and the needle plate tongue is turned across the rocking locus of the looper when the same is shifted from the operative position to the inoperative position.

In a lock stitch machine disclosed in Japanese Utility Model Publication No. Sho 63-32702, the needle plate tongue is pressed against and held on the throat plate. Therefore, the inoperative position of the needle plate tongue is near and below the throat plate and on the front side of the throat plate with respect to the feed direction. Accordingly, when the needle plate tongue is moved forward by hand in a horizontal plane, a portion of the needle plate tongue, which is disposed beside the stitch tongue, collides with the edge of the throat plate and is bent elastically downward below the throat plate. Thus, the needle plate tongue needs to be bent elastically when the same is shifted in a horizontal plane from the operative position to the inoperative position.

In the lock stitch machine disclosed in Japanese Patent Publication No. Sho 54-27785, the looper must be moved away from the path of the needle plate tongue before shifting the needle plate tongue to avoid interference between the looper and the needle plate tongue, requiring an additional operation when shifting the needle plate tongue. In the lock stitch machine disclosed in Japanese Utility Model Publication No. Sho 63-32702, it is difficult to shift the needle plate tongue because the needle plate tongue needs to be bent forcibly and it is therefore difficult to provide the lock stitch machine with an automatic mechanism for shifting the needle plate tongue.

SUMMARY OF THE INVENTION

The invention has been made to solve the foregoing problems and it is therefore an object of the invention to provide a lock stitch machine capable of quickly and easily making a change in stitching mode between an overcasting mode and a hemming mode.

To achieve the object, the invention provides a lock stitch machine comprising: a needle; a looper; a throat plate; a stitch tongue fixed to one end of the throat plate, directed in the feed direction and capable of hemming the rolled edge of a workpiece in cooperation with the needle and the looper; and a needle plate tongue capable of being shifted between an operative position where the needle plate tongue overcasts the flat edge of a workpiece in cooperation with the needle and the looper, and an inoperative position where the needle plate tongue is held during hemming; and a shifting means for shifting the needle plate tongue between the operative position and the inoperative position along a path outside the operating region of the looper.

In the lock stitch machine thus structured, the shifting means is capable of shifting the needle plate tongue between the operative position and the inoperative position without making the needle plate tongue touch the throat plate along the path outside the operating region of the looper. Thus, the needle plate tongue can be easily shifted regardless of the position of the looper. Since the needle plate tongue of the lock stitch machine in accordance with the invention can be shifted from the operative position to the inoperative position regardless of the position of the looper, the position of the looper need not be adjusted for shifting the needle plate tongue and, consequently, the stitching mode can be quickly changed for efficient stitching operation. Since the needle plate tongue is separated from the throat plate, the needle plate tongue can be easily shifted by a compact pulse motor having a comparatively small capacity, which enables the lock stitch machine to be constructed with a comparatively small size and reduces the cost of the lock stitch machine.

BRIEF DESCRIPTION OF THE DRAWINGS

A preferred embodiment of the invention will be described in detail with reference to the accompanying drawings, in which.

DETAILED DESCRIPTION OF THE PREFERRED EMBODIMENTS

A lock stitch machine in a preferred embodiment according to the invention will be described hereinafter with reference to the accompanying drawings, in which the arrow F indicates the feed direction in which a workpiece is fed, the arrow B indicates a direction opposite to the feed direction, the arrow R indicates a rightward direction perpendicular to the feed direction with respect to the position of the operator, and the arrow L indicates a leftward direction perpendicular to the feed direction. When the lock stitch machine is stopped, a needle N and a looper E stop respectively at the positions indicated by alternate long and short dash lines in FIG. 3. The operating region M of the looper E is indicated by alternate long and short dash lines in FIGS. 4 and 7.

Figure 1:
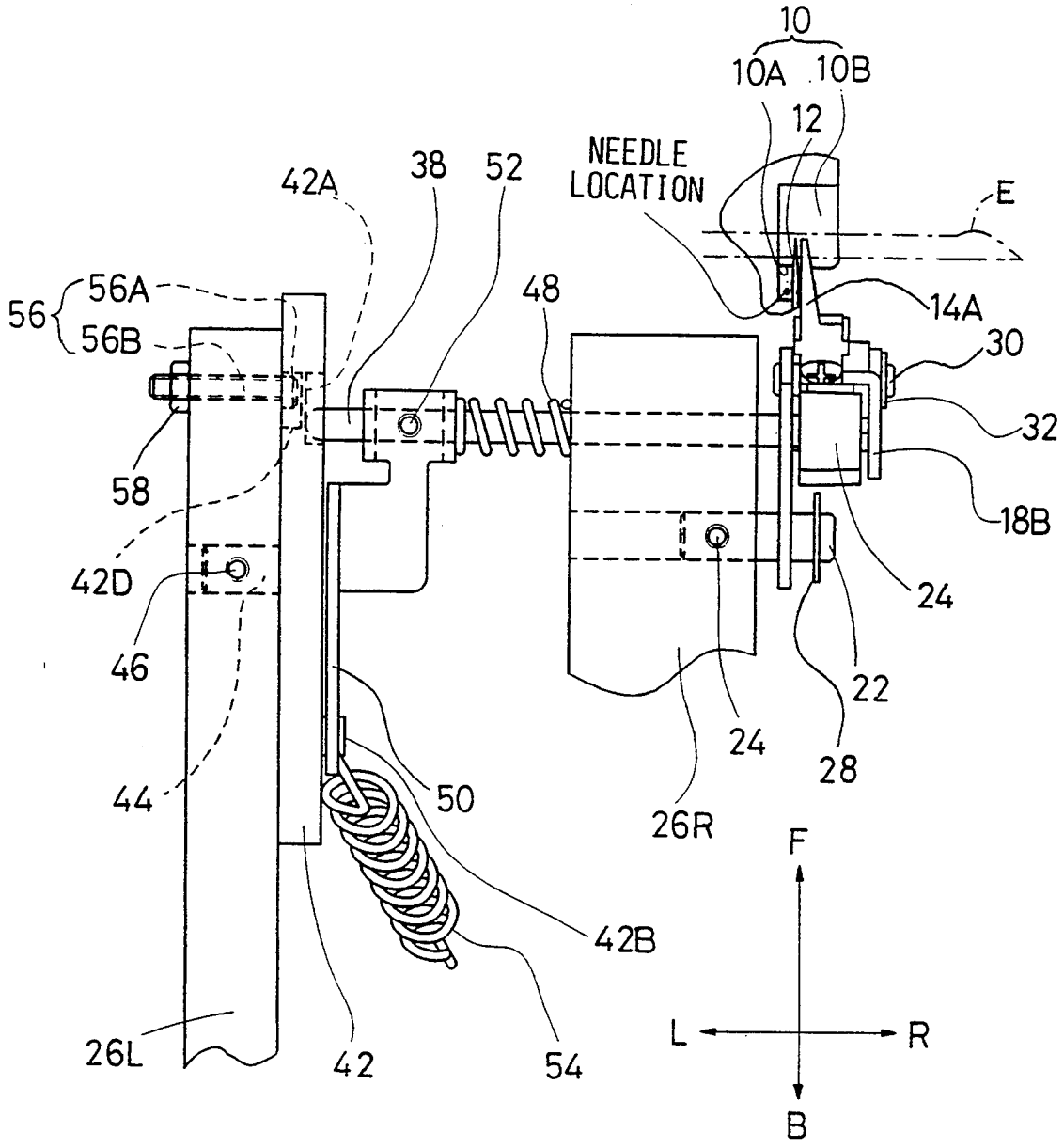
FIG. 1 is a plan view of an essential portion of a lock stitch machine in a preferred embodiment according to the invention with an needle plate tongue positioned at its operative position.

Referring to FIG. 1, a throat plate 10 is provided with an opening 10A at a needle location where the needle N passes. A slope 10B declining from the upper surface of the throat plate 10 toward the opening 10A is formed in a rear portion of the throat plate 10 with respect to the opening 10A. A stitch tongue 12, like a fine needle, is fixed to the right-hand end of the throat plate 10 at a position on the front side with respect to the opening 10A and on the right-hand side with respect to the needle location. The stitch tongue 12 is extended along the direction F with its upper surface included in a plane including the upper surface of the throat plate 10 and with its point positioned in the upper portion of the slope 10B.

A needle plate tongue 14 is disposed on the right-hand side of the stitch tongue 12 so as to extend in parallel to the stitch tongue 12. One end 14A of the needle plate tongue 14 is tapered toward a point by forming its right-hand surface and lower surface in slopes to facilitate clearing the thread from the needle plate tongue 14.

Figure 2:
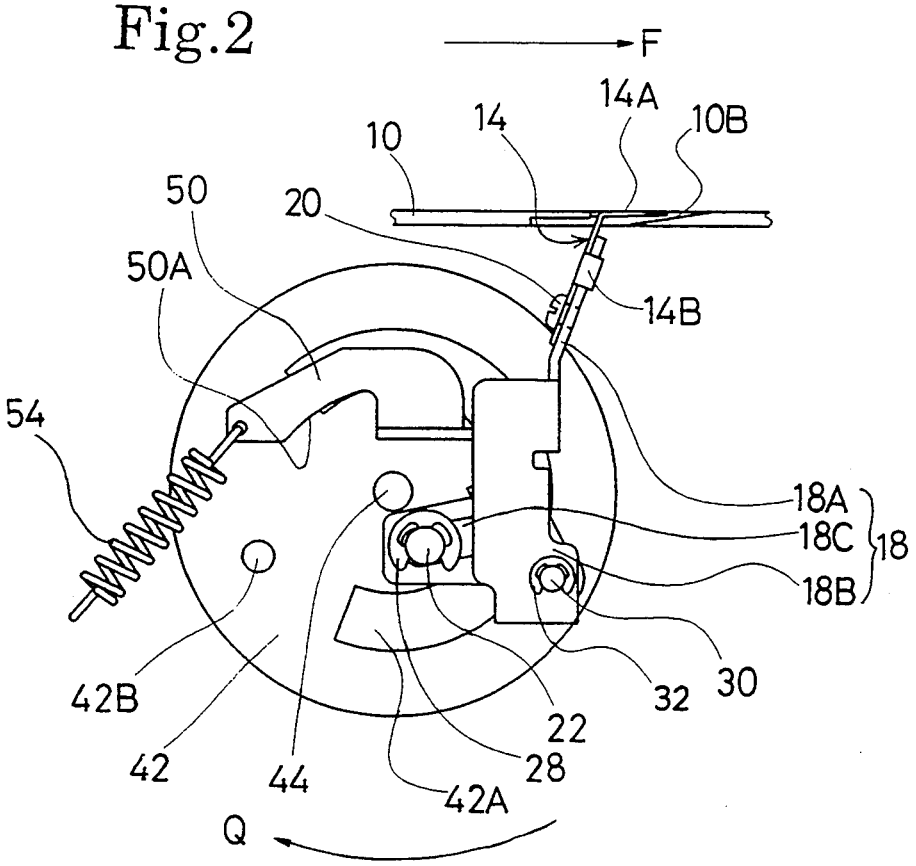
FIG. 2 is a right-hand side view of the portion shown in FIG. 1 of the lock stitch machine.

As shown in FIG. 2, the middle portion of the needle plate tongue 14 is bent and the upper portion thereof extends in the direction F parallel to the throat plate 10. Positioning lugs 14B are formed in the lower portion of the needle plate tongue 14. The lower portion of the needle plate tongue 14 is fastened to a holding member 18 by a screw 20 passing through a slot in the needle plate tongue 14. The positioning lugs 14B engage a seating portion 18A of the holding member 18. The screw 20 is loosened for positional adjustment of the needle plate tongue 14, up and down along the slot, relative to the holding member 18.

Figure 3:
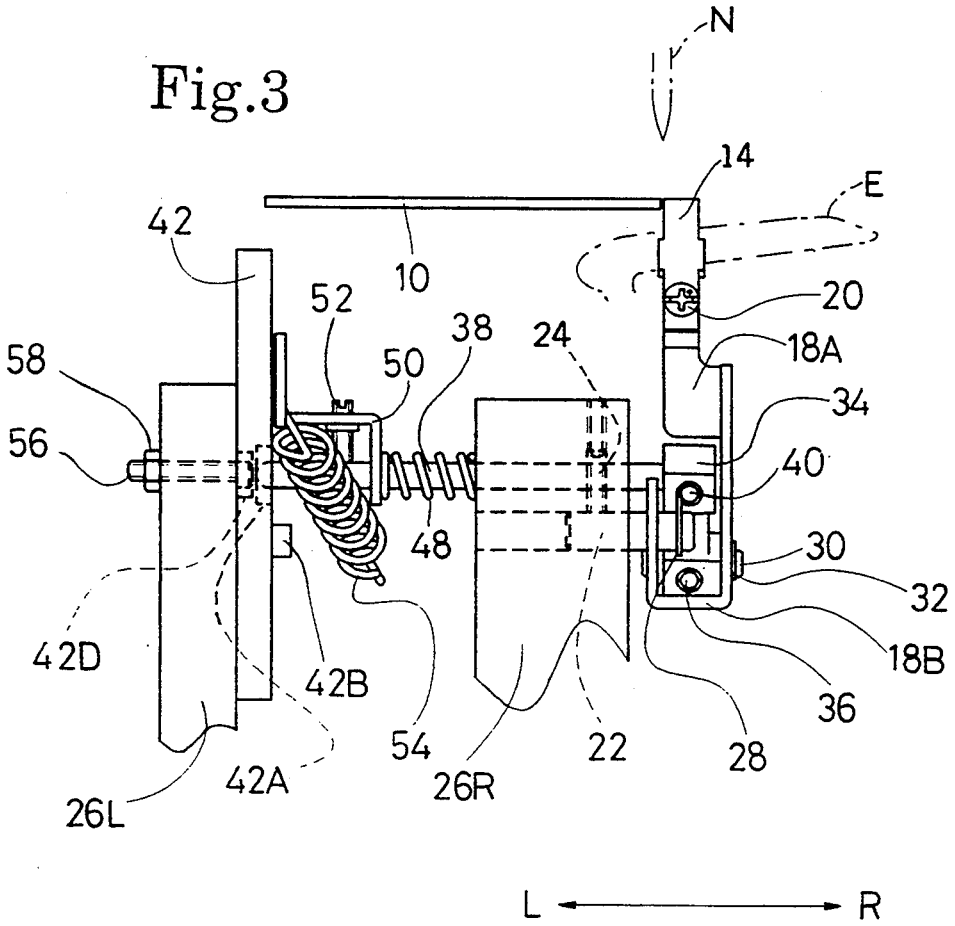
FIG. 3 is a front view of the portion shown in FIG. 1 of the lock stitch machine.

As shown in FIGS. 2 and 3, the holding member 18 has the seating portion 18A, a base portion 18B and a slot 18C. The seating portion 18A extends obliquely upward in the direction F from the upper end of the base portion 18B. The base portion 18B has a shape substantially resembling the letter U as viewed in the direction F (FIG. 3). The slot 18C is formed in a wall of the base portion 18B opposite to the other wall of the holding member 18 from which the seating portion 18A extends. The slot 18C extends obliquely upward in the direction F. A shaft 22 has one end fitted in a hole formed in a frame 26R and fixed in place with a screw 24 and the other end received in the slot 18C. A retaining ring 28 is seated on the free end of the shaft 22 to retain the holding member 18 on the shaft 22.

A shaft 30 is supported for rotation at its opposite ends in openings in the opposite walls of the base portion 18B in parallel to the shaft 22 and held in place with retaining rings 32 seated on the opposite ends thereof. One end of a link 34 is fixed to the middle portion of the shaft 30 with a screw 36. One end of a control shaft 38 is fixed to the other end of the link 34 so as to extend in parallel to the shaft 30. The middle portion of the control shaft 38 is supported for rotation and axial sliding on the frame 26R.

Figure 4:
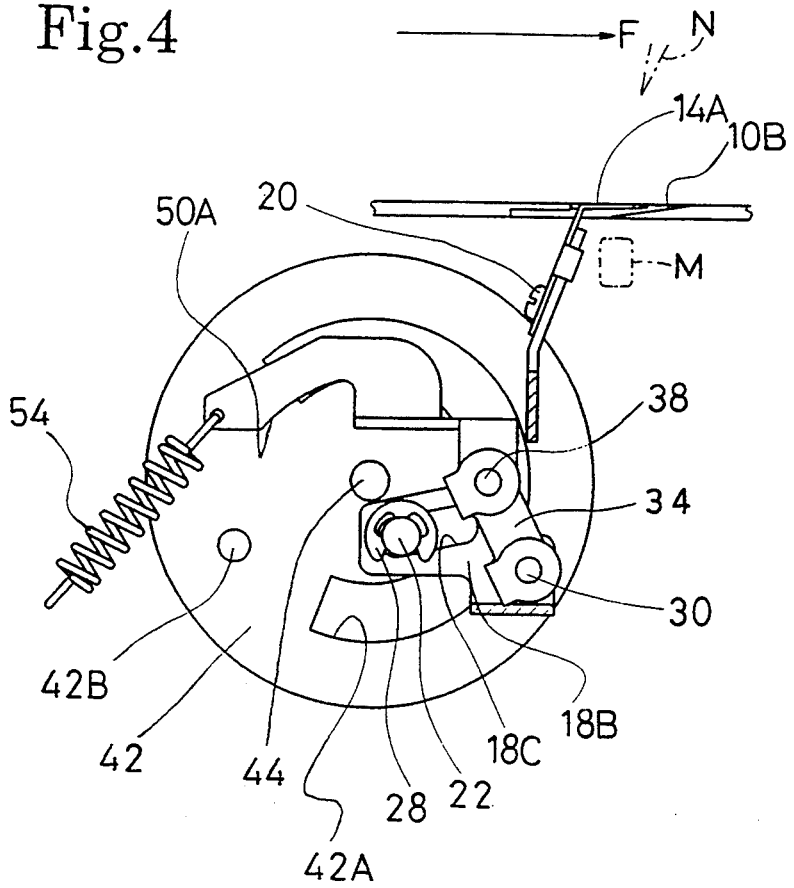
FIG. 4 is a partly cutaway right-hand side view, similar to FIG. 2, of the portion shown in FIG. 1.
Figure 5:
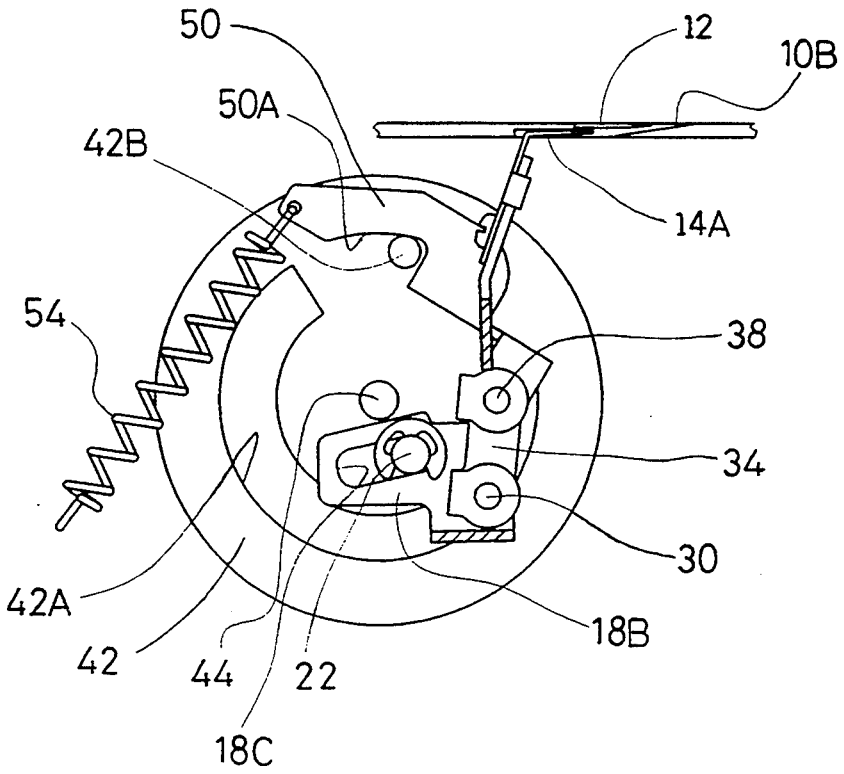
FIG. 5 is a partly cutaway right-hand side view of the portion shown in FIG. 1 of the lock stitch machine with the needle plate tongue positioned at its inoperative position.

When the control shaft 38 slides axially, namely, in the direction R or L, the holding member 18 connected to the control shaft 38 by the link 34 moves in the direction R or L. When the control shaft 38 turns, the link 34 turns the holding member 18, so that the holding member 18 turns on the control shaft 38 and, at the same time, the holding member 18 moves obliquely upward or downward as the slot 18C moves relative to the shaft 22. The center of a circle along which the needle plate tongue 14 moves is above the throat plate 10. The horizontal displacement of the needle plate tongue 14 is greater than the vertical displacement of the same. The upper portion 14A of the needle plate tongue 14 thus moves into and from a region above the operating region M of the looper E (FIG. 4) from and into a position under and separated from the throat plate 10 (FIG. 5).

As shown in FIG. 1, the other end of the control shaft 38 is in engagement with a grooved cam 42A formed in one surface of a disk-like overcasting width adjusting knob 42. The overcasting width adjusting knob 42 is supported on a shaft 44, the shaft 44 supported on a frame 26L and fixedly held in place on the frame 26L with a screw 46, so that the operator is able to turn the overcasting width adjusting knob 42. The grooved cam 42A has the shape of a circular arc which is a portion of a circle having its center on the axis of the shaft 44 and has a gradually varying depth. When the overcasting width adjusting knob 42 is turned, the control shaft 38 is moved in the direction R or L according to the turning direction of the overcasting width adjusting knob 42.

A maximum overcasting width is set when the other end of the control shaft 38 is in engagement with a lower end, as viewed in FIG. 2, of the grooved cam 42A, a minimum overcasting width is set when the other end of the control shaft 38 is in engagement with the middle portion of the grooved cam 42A, and a middle overcasting width is set when the other end of the control shaft 38 is in engagement with the upper end, as viewed in FIG. 2.

A compression spring 48 is positioned on a portion of the control shaft 38 extending on the left-hand side of the frame 26R, and a guide plate 50 is placed on and fixed with a screw 52 to the control shaft 38 at its one end so as to compress the compression spring 48 to hold the control shaft 38 continuously in engagement with the grooved cam 42A. An edge 50A of the guide plate 50 comes into engagement with a projection 42B projecting from the surface of the overcasting width adjusting knob 42 when the overcasting width adjusting knob 42 is turned. When the overcasting width adjusting knob 42 is turned, the control shaft 38 is turned by the guide plate 50. An extension spring 54 has one end attached to a frame, not shown, and the other end attached to the other end of the guide plate 50. Thus, the holding member 18 is positioned through the control shaft 38 as shown in FIGS. 2 and 4.

Figure 6:
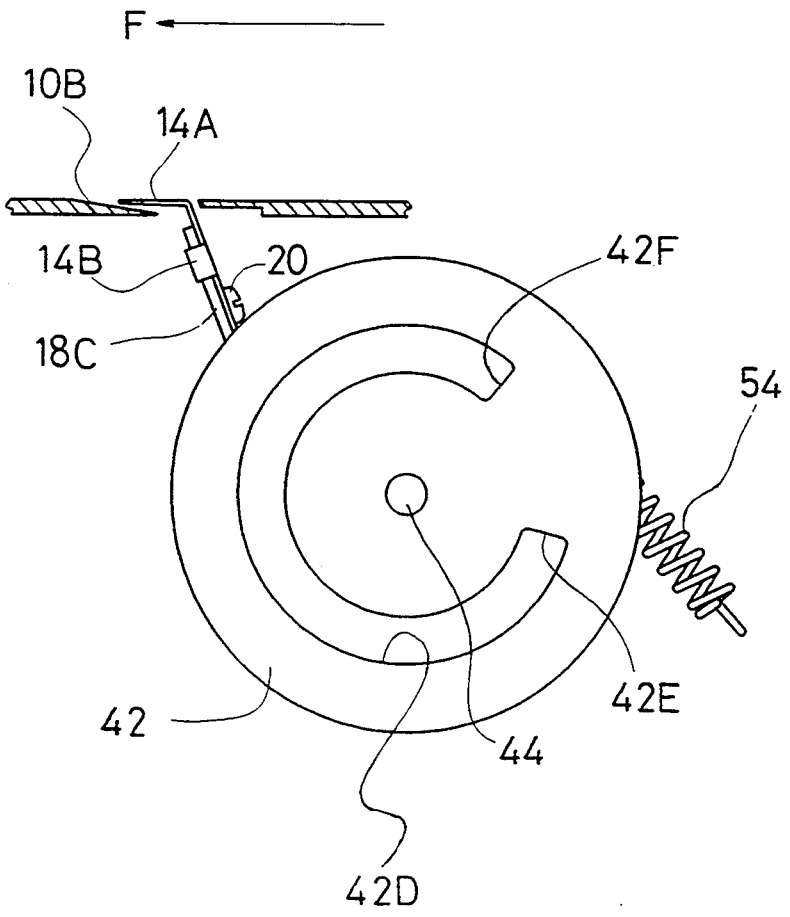
FIG. 6 is a left-hand side view of the portion shown in FIG. 1 of the lock stitch machine.

As shown in FIG. 6, a guide groove 42D is formed in the other surface of the overcasting width adjusting knob 42. The guide groove 42D has the shape of a circular arc which is a portion of a circle having its center on the axis 44. The opposite ends 42E and 42F of the guide groove 42D serve as stoppers.

As shown in FIG. 1, a stopper pin 56 has an eccentric head 56A and a body 56B. The eccentric head 56A of the stopper pin 56 is received in the guide groove 42D, the body 56B is inserted through a hole formed in the frame 26L, and a nut 58 is screwed on the body 56B to fasten the stopper pin 56 to the frame 26L. The angular range of turning of the overcasting width adjusting knob 42 is limited by the stopper pin 56, i.e., the turning of the overcasting width adjusting knob 42 in one direction is limited by the engagement of the stopper pin 56 and the end 42E of the guide groove 42, and in the opposite direction by the engagement of the stopper pin 56 and the end 42F of the guide groove 42.

The operation for shifting the needle plate tongue 14 from the operative position (FIGS. 1 and 2) to the inoperative position (FIG. 5) below the surface of the throat plate 10 will be described hereinafter.

When the overcasting width adjusting knob 42 is turned in a direction Q indicated by the arrow from the position shown in FIG. 2, the depth of the grooved cam 42A of the overcasting width adjusting knob 42 at the position corresponding to the control shaft 38 decreases gradually. Consequently, the control shaft 38 slides in the direction R to move the needle plate tongue 14 toward the central portion of the opening 10A or a middle overcasting width.

Figure 7:
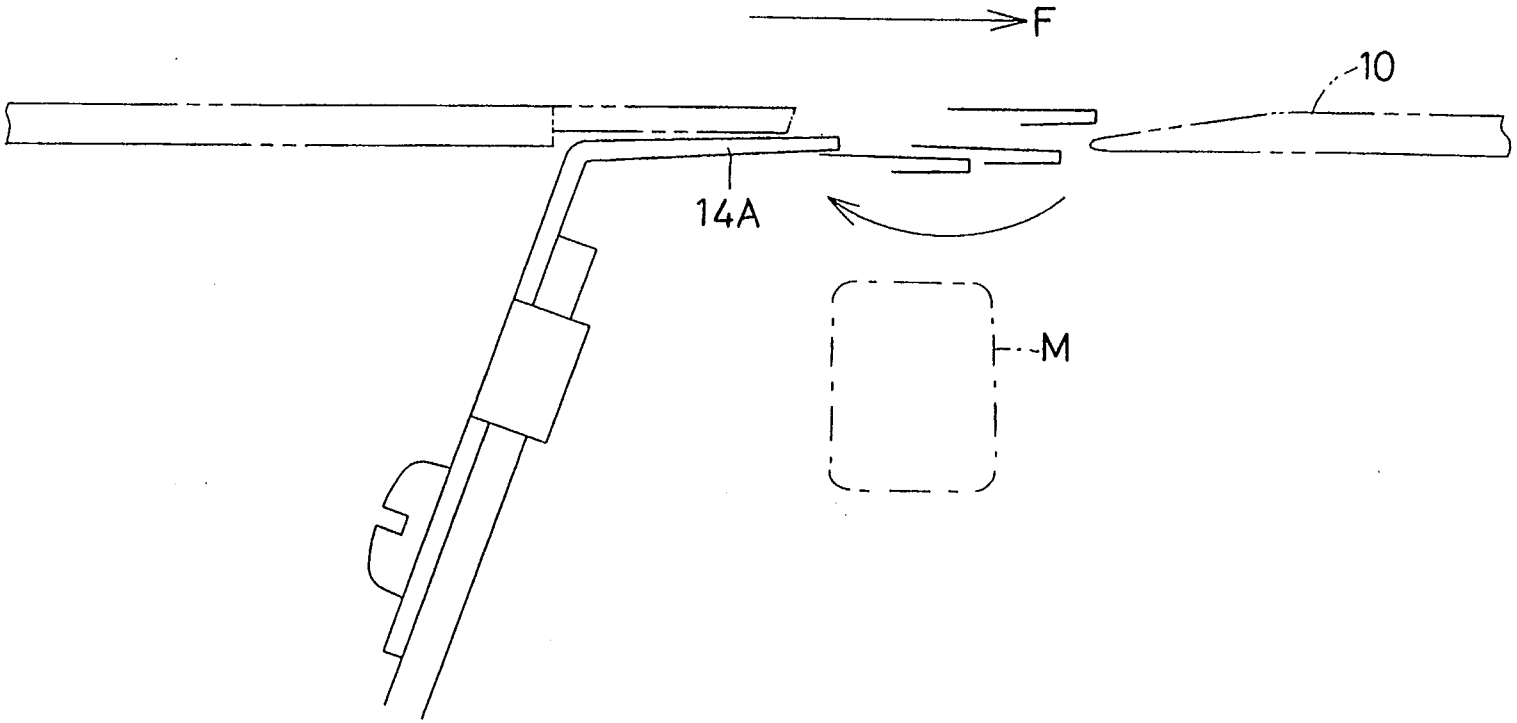
FIG. 7 is a fragmentary view of assistance in explaining the movement of the needle plate tongue toward its inoperative position.

As the overcasting width adjusting knob 42 is turned further in the direction Q, the projection 42B comes into engagement with the edge 50A of the guide plate 50 and, consequently, the control shaft 38 is turned in the direction Q, so that the holding member 18 is shifted obliquely downward from a position shown in FIG. 4 to a position shown in FIG. 5. When the holding member 18 is thus shifted, the upper portion 14A of the needle plate tongue 14 moves along an arcing path in a region above the operating region M of the looper E and under the throat plate 10 without touching the throat plate 10 as shown in FIG. 7. Thus, the needle plate tongue 14 can be shifted from the operative position to the inoperative position to enable the hem stitching operation regardless of the position of the looper E. The turning of the overcasting width adjusting knob 42 is limited by the engagement of the eccentric head 56A of the stopper pin 56 and the end 42F of the guide groove 42D.

When forming overcast stitches, the needle plate tongue 14 can be shifted together with the thread twining itself around the needle plate tongue 14 because a loop of the thread extended between the needle plate tongue 14 and the stitch tongue 12 can be expanded to some extent. After the needle plate tongue 14 has been moved slightly in the direction R, the needle plate tongue 14 is moved in the direction B to clear the thread twining itself around the needle plate tongue 14 from the needle plate tongue 14. Since the needle plate tongue 14 around which the thread twines itself can be thus shifted from the operative position to the inoperative position, the loop of the thread extended between the needle plate tongue 14 and the stitch tongue 12 need not be cut. Since the component parts for changing the stitching mode can be used also for changing the overcasting width when forming overcast stitches, the number of the component parts and the cost of the lock stitch machine can be reduced accordingly.

The needle plate tongue 14 can be shifted from the inoperative position to the operative position by turning the overcasting width adjusting knob 42 in the reverse direction, that is, opposite to the direction Q. When the overcasting width adjusting knob 42 is turned in the reverse direction, the foregoing needle plate tongue 14 shifting process is reversed and the needle plate tongue 14 is moved in the reverse direction along the arcing path shown in FIG. 7 to shift from the inoperative position to the operative position.

The invention is not limited in its practical application to the embodiment specifically described above and many changes and variations may be made therein without departing from the scope and spirit of the invention.

The needle plate tongue 14 and the holding member 18 may be formed in an integral member. The compression spring 48 and the extension spring 54 may be substituted by a single torsion coil spring having expansibility and torsibility. The overcasting width adjusting knob may be turned either manually by the operator or automatically by a stepping motor or the like. Since the overcasting width adjusting knob 42 is turned to determine the stitching mode and the overcasting width, and the stitching mode and the overcasting width are dependent on the angular position of the overcasting width adjusting knob, the process of determining the stitching mode and the overcasting width can be easily automated.

Although the upper portion 14A of the needle plate tongue 14 moves in the range separated from the operating range of the looper E when shifting the needle plate tongue 14 between the operative position and the inoperative position in the foregoing embodiment, the upper portion 14A of the needle plate tongue 14 may be moved in a range separated from a looper stopping range in which the looper E is held if the looper E is moved into the looper stopping range whenever the lock stitch machine is stopped.

What is claimed is:

1. A lock stitch machine, comprising:

a needle;

a looper;

a stitch tongue fixed to one end of a throat plate so as to extend along a feed direction on which a workpiece is fed in order to hem the edge of a workpiece in cooperation with the needle and the looper;

a repositionable needle plate tongue shifted between an operative position where the needle plate tongue overcasts the flat edge of a workpiece in cooperation with the needle, the looper and the stitch tongue, and an inoperative position recessed substantially beneath the throat plate where the needle plate tongue is held outside operating ranges of the needle, the looper and the stitch tongue to enable hemming operation; and needle plate tongue shifting means for shifting the needle plate tongue between the operative position and the inoperative position without passing through the operating region of the looper and without touching the throat plate, the needle plate tongue at the operative and at the inoperative positions being substantially parallel to the feed direction.

2. A lock stitch machine according to claim 1, wherein the needle plate tongue is shifted between the operative position and the inoperative position along a substantially arc shaped path by said needle plate tongue shifting means.

3. A lock stitch machine according to claim 1, wherein said needle plate tongue shifting means shifts the needle plate tongue between the operative position and the inoperative position through a region bounded at a lower side by the operating region of the looper and bounded at an upper side by the throat plate, said needle plate tongue following a path transverse to the orientation of the looper.

4. The lock stitch machine as claimed in claim 1, wherein said needle plate tongue shifting means comprises:

a shaft mounted to a first side frame of the lock stitch machine;

an adjusting knob rotatably mounted to said shaft, said adjusting knob having a first camming groove on a side adjacent to the first side frame and a second camming groove on a side away from the first side frame;

a stopper pin mounted in the first side frame and engaging said first camming groove to limit rotation of said adjusting knob;

a control shaft engaged in said second camming groove;

a guide plate fixedly mounted to said control shaft;

a projection formed on a surface of said adjusting knob on the side away from said first side frame for engaging said guide plate;

a spring linking said guide plate to a frame of the lock stitch machine;

a link rotatably mounted to an end of said control shaft, said control shaft passing through a second side frame to expose said end;

a compression spring mounted on said control shaft between said guide plate and the second side frame; and a holding member rotatably mounted to said link and further engaged by a pin extending from the second side frame through a slot in said holding member, said holding member fixedly connected to said needle plate tongue.

5. A lock stitch sewing machine, comprising:

a needle;

a looper;

a throat plate having a sloped portion;

a stitch tongue extending in a feed direction and attached to said throat plate;

a needle plate tongue mounted in the sewing machine for movement between an operative position over said sloped portion of said throat plate and an inoperative position that is withdrawn from said sloped portion and recessed substantially beneath said throat plate and outside operating regions of the needle, the looper, and the stitch tongue; and needle plate tongue moving means for moving said needle plate tongue between said operative and inoperative positions without passing through the operating region of the looper, the needle plate tongue at the operative and at the inoperative positions being substantially parallel to the feed direction.

6. The lock stitch sewing machine as claimed in claim 5, wherein displacement in a first direction transverse to an axis of the needle is greater than displacement in a second direction parallel to the axis of the needle of said needle plate tongue.

7. The lock stitch sewing machine as claimed in claim 6, wherein said needle plate tongue moves along a substantially arc shaped path.

8. The lock stitch sewing machine as claimed in claim 7, wherein said arc shaped path is bounded at a lower side by the operating region of the looper.

9. The lock stitch sewing machine as claimed in claim 5, wherein said needle plate tongue moving means comprises:

a shaft mounted to a first side frame of the lock stitch machine;

an adjusting knob rotatably mounted to said shaft, said adjusting knob having a first camming groove on a side adjacent to the first side frame and a second camming groove on a side away from the first side frame;

a stopper pin mounted in the first side frame and engaging said first camming groove to limit rotation of said adjusting knob;

a control shaft engaged in said second camming groove;

a guide plate fixedly mounted to said control shaft;

a projection formed on a surface of said adjusting knob on the side away from said first side frame for engaging said guide plate;

a spring linking said guide plate to a frame of the lock stitch machine;

a link rotatably mounted to an end of said control shaft, said control shaft passing through a second side frame to expose said end;

a compression spring mounted on said control shaft between said guide plate and the second side frame; and a holding member rotatably mounted to said link and further engaged by a pin extending from the second side frame through a slot in said holding member, said holding member fixedly connected to said needle plate tongue.

* * * * *